US005549374A

United States Patent [19]

Krivec

[11] Patent Number: 5,549,374

[45] Date of Patent: Aug. 27, 1996

[54] MODULAR CABINET AND DRAWER ASSEMBLY

[75] Inventor: Bert Krivec, Waukesha, Wis.

[73] Assignee: Snap-on Technologies, Inc., Crystal Lake, Ill.

[21] Appl. No.: 461,062

[22] Filed: Jun. 5, 1995

[51] Int. Cl.[6] ..... A47B 43/00

[52] U.S. Cl. ..... 312/257.1; 312/330.1; 312/334.16; 312/350; 312/263; 312/261; 384/42

[58] Field of Search ..... 312/257.1, 261, 312/263, 330.1, 350, 334.16; 384/42

[56] References Cited

U.S. PATENT DOCUMENTS

| | | | |
|---|---|---|---|
| 162,267 | 4/1875 | Bleyley . | |
| 2,281,690 | 6/1940 | Hedlund . | |
| 2,312,325 | 3/1943 | Earle . | |
| 2,414,095 | 1/1947 | Dewey . | |
| 2,488,916 | 11/1949 | Johnson . | |
| 2,503,599 | 4/1950 | Smayda, Jr. et al. | 312/350 |
| 2,539,963 | 1/1951 | Moberg | 312/350 X |
| 2,547,463 | 4/1951 | Haut . | |
| 2,574,692 | 11/1951 | Davidson et al. | 312/350 X |
| 2,599,240 | 6/1952 | Ellerson . | |
| 2,646,333 | 7/1953 | Abrahamson et al. | 312/334.16 |
| 2,751,272 | 6/1956 | Hutzelman | 312/334.16 |
| 2,757,051 | 7/1956 | Wilmer et al. | 312/334.16 X |
| 2,759,773 | 8/1956 | Wilmer et al. | 312/334.16 X |
| 2,905,519 | 9/1959 | O'Neil | 312/330.1 X |
| 3,222,117 | 12/1965 | Schwartz | 312/350 X |
| 3,339,994 | 9/1967 | Reddig et al. . | |
| 3,550,978 | 12/1970 | Magee | 312/350 |
| 3,700,300 | 10/1972 | Davis et al. . | |
| 3,740,109 | 6/1973 | Pfaffendorf et al. | 312/261 X |
| 3,765,540 | 10/1973 | Escolano Serrano et al. . | |
| 4,950,039 | 8/1990 | Helling et al. | 312/249.11 X |
| 5,016,948 | 5/1991 | Welch et al. | 312/257.1 X |
| 5,069,466 | 12/1991 | Propst | 312/350 X |
| 5,215,362 | 6/1993 | Zoellner . | |
| 5,259,668 | 11/1993 | Teufel et al. | 312/263 X |
| 5,281,020 | 1/1994 | Romick . | |

FOREIGN PATENT DOCUMENTS

| | | | |
|---|---|---|---|
| 3901481 | 7/1990 | Germany | 312/263 |

OTHER PUBLICATIONS

NASA Technical Briefs, Spring 1980, Foam Filled Cushions for Sliding Trays.

*Primary Examiner*—Peter M. Cuomo
*Assistant Examiner*—Rodney B. White
*Attorney, Agent, or Firm*—Emrich & Dithmar

[57] ABSTRACT

A cabinet assembly capable of storing various configurations of drawers of different depth is provided. The cabinet assembly includes first and second walls each having a length and height, and first and second one-piece support members each having a length and a height and integral with the first and second walls, respectively. Each of the support members includes a plurality of ledges spaced along the height of the support member substantially perpendicular to the associated wall, the walls being disposed so that each ledge on the first support member cooperates with a corresponding ledge on the second support member to form a pair of opposed ledges. The assembly also includes a plurality of drawers each having a depth and a pair of support flanges lying substantially in a common plane, wherein the support flanges lying substantially in a common plane, wherein the support portions of each pair of support ledges are adapted to respectively slidably support the flanges of a drawer to both support the drawer between the walls and allow the drawer to slide along at least a portion of the ledges.

18 Claims, 1 Drawing Sheet

3
14
18
10
36A
12
36B
36C
20
38
36D
3
40
16

24A
26
34

46
14
48
28
50
30
26A
26A
32
40
42
36A
18
20
22
40
44
26B
26B
38
40
40
26C
26C
36B
44
26D
26D
36C
24B
24A
34
46
46
36
26E
36
52
54
26E
36D
34
10
16

24'
48'
46'
28'
26'
36'

50
46
56
48
54
40
30
28
52
26
32

26A
26B
36E
26C
36F
26D
26E
24A 26A
26B
36G
26C
26D
26E
36H
24A

MODULAR CABINET AND DRAWER ASSEMBLY

BACKGROUND OF THE INVENTION

1. Field of the Invention

This invention relates to cabinets and, more particularly, to cabinets capable of housing a variety of drawers of different depths.

2. Description of the Prior Art

Most prior cabinets have been equipped with a fixed configuration of drawers. Consumers, in the past, therefore, have been limited in buying storage cabinets equipped with only one configuration of storage drawers. This has caused them to conduct lengthy searches to find the exact storage device to fit their precise needs or has not allowed them to store their belongings in the manner that they desired. Further, if their storage needs change, they are either forced to buy an entire new cabinet or attempt to rearrange their belongings in their current cabinet.

Though there are now available some modular storage cabinets for housing interchangeable and differently-sized drawers, they are constructed with intricate multi-part cabinet and drawer guides and slides. This multi-part intricate design is time-consuming and costly to construct and to install.

SUMMARY OF THE INVENTION

It is a general object of the invention to provide an improved cabinet assembly which avoids the disadvantages of prior assemblies while affording additional structural and operational advantages.

An important feature of the invention is the provision of a modular cabinet assembly which is of relatively simple and economical construction.

A further feature of the invention is the provision of a cabinet assembly which allows a wide variety of interchangeable configurations of drawers of different depths to be utilized.

These and other features of the invention are attained by providing a cabinet assembly capable of storing various configurations of drawers of different depth. The cabinet assembly comprises first and second walls having a length and height, first and second one-piece support members each having a length and a height integral with the first and second walls, respectively. Each of the support members include a plurality of ledges spaced along the height of the support portion substantially perpendicular to the associated wall, the walls being disposed so that each ledge on the first support member cooperates with a corresponding ledge on the second support member to form a pair of opposed ledges. The assembly also includes a drawer having a depth and a pair of support flanges lying substantially in a common plane, wherein the support portions of a pair of support ledges are adapted to respectively slidably support the flanges of the drawer to both support the drawer between the walls and allow the drawer to slide along at least a portion of the ledges.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
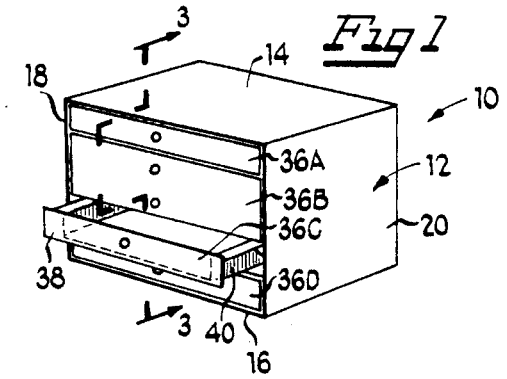
FIG. 1 is a perspective view of the cabinet assembly of the present invention.
Figure 3:
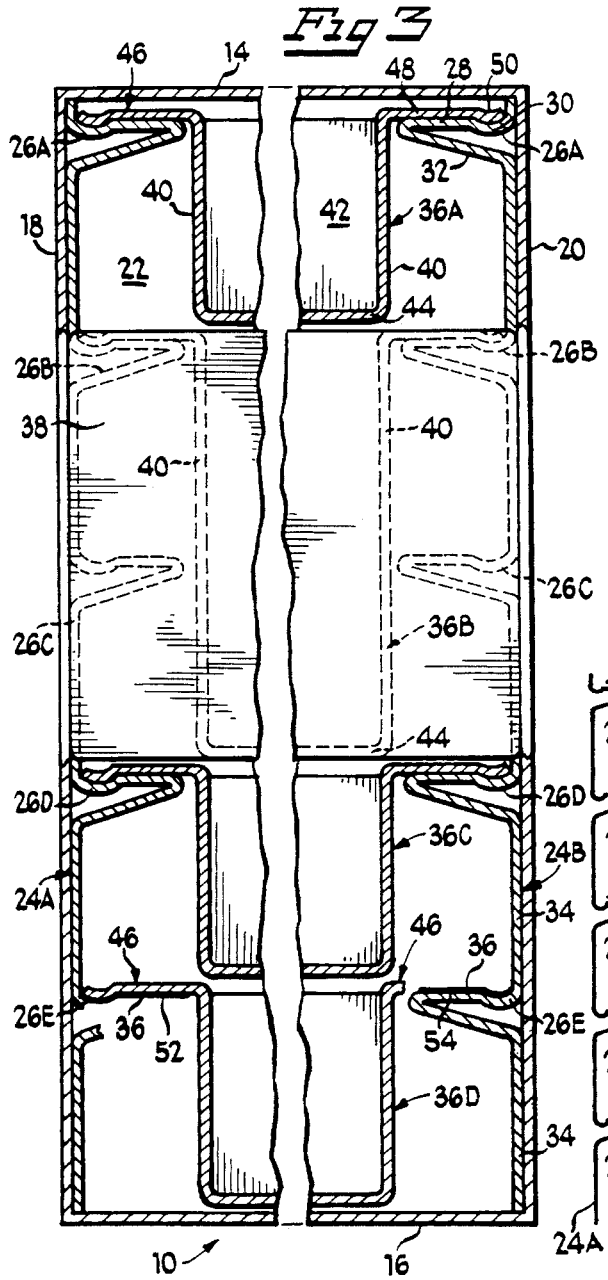
FIG. 3 is a further enlarged sectional view, in which elements have been partially broken away, taken generally along line 3—3 in FIG. 1.

As seen in FIG. 1, a cabinet assembly 10 is provided. Referring to FIGS. 1 and 3, the cabinet assembly 10 includes an open-front outer shell 12 having a top wall 14 and a bottom wall 16 parallel to one another. The outer shell 12 further includes first and second generally parallel sidewalls 18, 20 connected to the top and bottom walls 14, 16 and a back wall 22 connected to the top, bottom and sidewalls 14, 16, 18 and 20.

Figure 2:
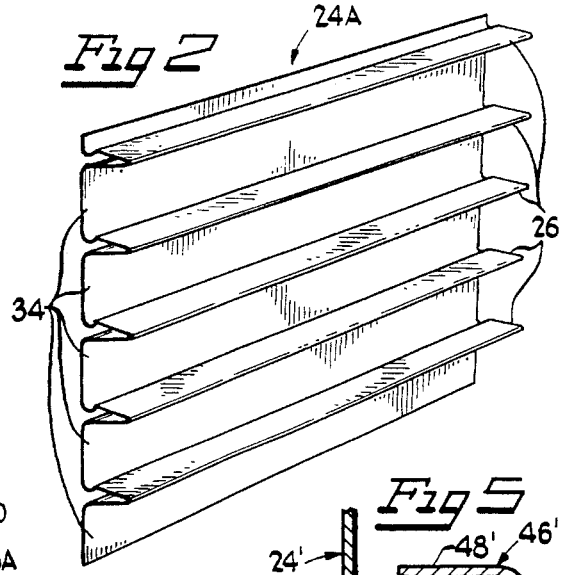
FIG. 2 is an enlarged perspective view of a support member of the cabinet assembly of FIG. 1.
Figure 4:
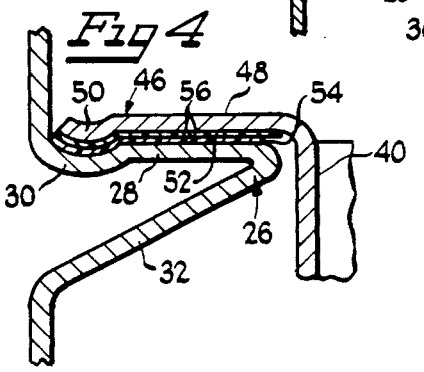
FIG. 4 is a still further enlarged, fragmentary sectional view illustrating the cooperation between a support member and a drawer flange of the cabinet assembly of FIGS. 1–3.

As best seen in FIG. 3, two identical support members 24A and 24B are, respectively, attached to each of the first and second sidewalls 18, 20. As best seen in FIGS. 2 and 3, each of the support members 24A and 24B is of unitary, one-piece construction and includes a plurality of vertically spaced ledges 26, each of which runs along the entire length of the support member. As seen in FIGS. 2–4, each ledge 26 is generally V-shaped in transverse cross section and includes a generally planar support portion 28 integral with an arcuate-shaped portion 30 and an angled portion 32 which forms an acute angle with the planar support portion 28. The acute angle formed between the planar support portion 28 and the angled portion 32 can be almost any angle that will provide some clearance between the arcuate-shaped portion 30 and the angled portion 32. Typically, the angle formed is a relatively small angle between about ten and fifteen degrees. This small angle allows the ledges 26 to be spaced closely together.

Each of the support members 24A and 24B also includes a plurality of reinforcing portions 34. Each reinforcing portion 34 is substantially perpendicular to the planar support portions 28 and is connected by any conventional means to the associated sidewall 18, 20. Each ledge 26 is connected to at least one of the reinforcing portions 34. Depending upon the application, the reinforcing portions 34 may be ribbed or otherwise shaped (not shown) to provide the ledges 26 with additional strength to support, as discussed below, a drawer. Also, attaching the support members 24A and 24B to a sidewall 18 or 20 provides each ledge 26 with additional support strength. Each ledge 26 can be further strengthened, if necessary, by attaching to the support member 24A or 24B, such as by spot welding a reinforcing strip (not shown) to bridge the gaps between the arcuate surfaces 30 and the angled portions 32.

As best seen in FIGS. 1 and 3, each ledge 26 of the support member 24A attached to the first sidewall 18 has a corresponding ledge 26 at substantially the same height on support member 24B attached to the second side wall 20, as measured from the top or bottom wall 14, 16. As seen best in FIG. 3, there are five pairs of corresponding ledges 26A–26E.

As seen in FIGS. 1 and 3, each corresponding pair of ledges 26A–26E is designed to support one or more of a number of drawers 36A–36D. Each of the drawers 36A–36D includes a face panel 38, connected to two parallel side panels 40, a back panel 42 connected to the side panels 40 and a bottom panel 44 connected to panels 38–42. Each side panel 40 is also unitary at its upper end with a laterally outwardly extending flange 46 which is substantially perpendicular to the associated side panel 40. As best seen in FIG. 4, each flange 46 has a generally planar portion 48 which rests on planar portion 28 of a ledge 26 and an arcuate-shaped portion 50 which is mateable with and rests on the arcuate-shaped portion 30 of a ledge 26.

The arcuate-shaped portions 30 of an opposed pair of the ledges 26 cooperate, respectively, with the portions 50 of the drawers 36A–36D to guide the drawer in a direction parallel to the sidewalls 18 and 20 when the drawers are manually moved into and out of the outer shell 12 and aids in inhibiting movement in a direction perpendicular to the sidewalls 18 and 20. This prevents the drawer side panels 40 from contacting the ledges 26, which contact would interfere with smooth sliding of the drawer between open and closed conditions.

As best seen in FIGS. 3–4, each flange 46 includes a bottom surface 52 and each ledge 26 includes a top surface 54 which are in facing relationship with each other. To facilitate sliding of the surfaces 52 and 54 relative to each other, one or both is preferably provided with a low-friction layer 56. As seen in FIG. 3, referring to the ledge pair 26E for purposes of illustration, at the left-hand side of the figure, the drawer flange 46 is provided with a low-friction layer 56, while at the right-hand side of the figure, the ledge 26E is provided with such a layer 56. As seen in FIG. 4, both of these surfaces 52, 54 have such layers 56, which may be any suitable medium with a low coefficient of friction. Depending on the application and the materials that the support member 24 and flanges 46 are constructed of, the low coefficient of friction medium 56 may need to be applied only to either the top surface 54 of the ledge 26 or the bottom surface 52 of the flange 46, or not applied at all. Almost any low coefficient of friction medium 56 may be used, including polytetrafluoroethylene tape of the type made by E. I. Dupont de Nemours & Co and sold under the trademark Teflon®.

Figure 5:
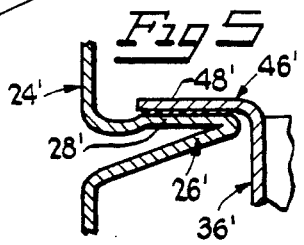
FIG. 5 is a reduced view similar to FIG. 4 illustrating an alternative drawer flange supported on a support member.

If an application does not require that there be means to guide the drawers 36A–36D in a direction parallel to the sidewalls 18, 20, the flanges 46 of each drawer 36A–36D would not require the arcuate-shaped portion 50 shown in FIGS. 3 and 4. For example, as seen in FIG. 5, an alternative flange 46' of a drawer 36' is illustrated. The flange 46' only has a generally planar portion 48' which is in slidable contact with a generally planar portion 28' of a ledge 26' of a support member 24'.

The present invention allows a wide variety of drawers of different depth to be housed in the outer shell 12. This is due in part to how the drawers 36A–36D are supported on the ledges 26, the spacing of the ledges 26 of the support members 24A, 24B and the depths of each drawer being selected to correspond to the spacing. As seen in FIGS. 2 and 3, the ledges 26 are equidistantly spaced along the height of each support member 24A, 24B. The depth of each of the drawers, i.e., the distance between the top of the flange 46 and the bottom of the bottom panel 44, and the height of the face panel 38 are designed to correspond to the spacing. Each drawer 36A–36D is designed to have a depth that is substantially equal to the distance between two ledges 26A–26E on a respective member 24A or 24B or any ledge 26A–26E and the bottom wall 16. This allows the cabinet assembly 10, as best seen in FIGS. 1, 3, 6 and 7, to house between one drawer and five drawers. If the ledges 26 are equidistantly spaced, as for example, 2 inches, and the bottom wall 16 is similarly spaced from the bottom pair of corresponding ledges 26E, as seen in FIGS. 1–3, then different configurations of drawers having depths of approximately 2, 4, 6, 8 and 10 inches could be housed in the cabinet assembly 10.

Additionally, as seen in FIG. 3, the distance between the side panels 40 of each drawer 36A–36D is less than the distance between any corresponding pair of ledges 26A–26E. This aids in preventing the sidewalls 40 of a drawer 36 which has a depth greater than the spacing between adjacent ledges 26 of support member 24A from contacting any corresponding pair of intermediately disposed ledges 26 which are adjacent sidewalls 40 and allows a drawer of any modular depth to move in and out of the outer shell 12.

As seen best in FIGS. 1 and 3, the ability of the cabinet assembly 10 to house varying sized drawers is camouflaged by the face panels 38 of the drawers 36A–36D, each of which has a height substantially equal to the depth of the respective drawer 36A–36D and a width greater than both the distance between the side panels 40 of the respective drawer 36A–36D and the distance between any corresponding pair of ledges 26A–26E and slightly less than the distance between the first and second sidewalls 18, 20 of the outer shell 12. The face 38 of each drawer 36A–36D, at least when the drawer is in a closed position, therefore blocks from the view of an observer not only the pair of ledges 26 it is supported by, but also any ledges 26 alongside its sidewalls 40.

Figure 6:
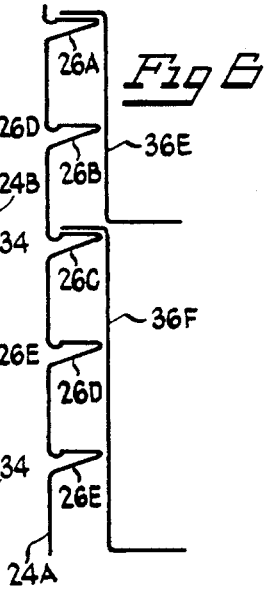
FIGS. 6 and 7 are schematic views illustrating various configurations of drawers of different depth being supported within the assembly of the present invention.
Figure 7:
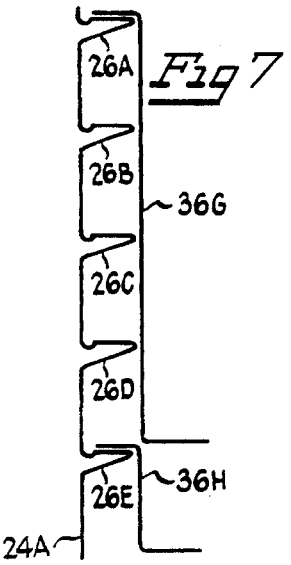

As discussed above, the present invention allows for a wide variety of configurations of differently sized drawers. FIGS. 1 and 3 illustrate an embodiment with four drawers 36A–36D, three of which 36A, 36C, 36D, have the same depth. FIGS. 6 and 7, schematically illustrate two different configurations of 2-drawer assemblies supported on support member 24A, illustrating how four different depth drawers 36E–36H can be used with the present invention.

Depending upon the application, the cabinet assembly 10, and all its elements, may be made from a metal or any suitable material, including plastic.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A cabinet assembly comprising:

first and second walls each having a length and height;

first and second one-piece support members each having a length and a height and integral with the first and second walls, respectively, each of the support members including a plurality of ledges spaced along the height of the support member and extending lengthwise thereof, each ledge having a support portion substantially perpendicular to an associated one of the walls, the walls being disposed so that each ledge on the first support member cooperates with a corresponding ledge on the second support member to form a pair of opposed ledges, each of said ledges including a guide channel formed in said support portion and extending lengthwise of the ledge; and a drawer having a depth and a pair of support flanges lying substantially in a common plane, each flange of the drawer including a guide portion mateable with the guide channel of its associated ledge, wherein the support portions of the pair of support ledges are adapted to respectively slidably support the flanges of the drawer to both support the drawer between the walls and allow the drawer to slide along at least a portion of the ledges.

2. The assembly of claim 1, wherein each guide channel is disposed adjacent to the integral one of the first and second walls, each drawer flange having a distal edge with each guide portion being disposed adjacent to the distal edge.

3. The assembly of claim 1, wherein the ledges of the first support member are equidistantly spaced apart along the height of the first support member and wherein the ledges of the second support member are equidistantly spaced apart along the height of the second support member.

4. The assembly of claim 1, wherein the first and second walls are substantially parallel to each other.

5. The assembly of claim 4, wherein the ledges of a pair of opposed ledges are spaced apart a first distance, and wherein the drawer includes side panels respectively connected to the flanges substantially perpendicular thereto, the side panels being spaced apart a second distance less than the first distance.

6. The assembly of claim 5, wherein the first and second walls are spaced apart a third distance, and wherein the drawer includes a face panel connected to the side panels substantially perpendicular thereto and having a length greater than the first distance and slightly less than the third distance.

7. The assembly of claim 1, wherein each guide channel and guide portion is arcuate in transverse cross section.

8. The assembly of claim 1 and further comprising a low coefficient of friction medium disposed on a portion of each ledge.

9. A cabinet assembly comprising:

first and second walls each having a length and height;

a bottom wall connected to the first and second walls substantially perpendicular thereto;

first and second one-piece support members each having a length and a height and integral with the first and second walls, respectively, each of the support members including a plurality of ledges spaced along the height of the support member and extending lengthwise thereof, each ledge having a support portion substantially perpendicular to an associated one of the walls, the walls being disposed so that each ledge on the first support member cooperates with a corresponding ledge on the second support member to form a pair of opposed ledges, each of said ledges including a guide channel formed in said support portion and extending lengthwise of the ledge; and a plurality of drawers, each drawer having a depth substantially equal to a distance between two of the ledges along the height of a support member or a distance between a ledge and a bottom wall, each drawer having a pair of support flanges lying substantially in a common plane, each flange of the drawer including a guide portion mateable with the guide channel of its associated ledge, wherein the support portions of each pair of support ledges are adapted to respectively slidably support the flanges of one of the drawers to both support the drawer between the walls and allow the drawer to slide along at least a portion of the ledges, and whereby the spacing of the ledges permits the edges to support drawers of different depths and allow the cabinet assembly to house different configurations of different depth drawers.

10. The assembly of claim 9, wherein each guide channel is disposed adjacent to the integral one of the first and second walls, each drawer flange having a distal edge with each guide portion being disposed adjacent to the distal edge.

11. The assembly of claim 9, wherein the ledges of the first support member are equidistantly spaced from one another along the height of the first support member and wherein the ledges of the second support member are equidistantly spaced along the height of the second support member.

12. The assembly of claim 10, wherein the first and second walls are substantially parallel to each other.

13. The assembly of claim 12, wherein the ledges of a pair of opposed ledges are spaced apart a first distance, and wherein each drawer includes side panels respectively connected to the flanges substantially perpendicular thereto, the side panels being spaced apart a second distance less than the first distance.

14. The assembly of claim 13, wherein the first and second walls are spaced apart a third distance, and wherein each drawer includes a face panel connected to the side panels substantially perpendicular thereto and having a length greater than the first distance and slightly less than the third distance.

15. The assembly of claim 9, wherein each guide channel and guide portion is are arcuate in transverse cross section.

16. The assembly of claim 9 and further comprising a low coefficient of friction medium disposed on a portion of each ledge.

17. The assembly of claim 9, wherein at least one of the drawers has a depth substantially equal to a distance between two adjacent ledges along the height of a support member.

18. The assembly of claim 9, wherein at least one of the drawers has a depth substantially equal to a distance between two non-adjacent ledges along the height of a support member.

* * * * *